United States Patent [19]

Godde

[11] Patent Number: 4,676,342

[45] Date of Patent: Jun. 30, 1987

[54] TRESTLE LADDER

[76] Inventor: Rainer Godde, Uberlinger Weg 1a, 8000 Munich 60, Fed. Rep. of Germany

[21] Appl. No.: 824,890

[22] Filed: Jan. 31, 1986

[30] Foreign Application Priority Data

Jan. 31, 1985 [DE] Fed. Rep. of Germany ..... 3503269
Jun. 5, 1985 [DE] Fed. Rep. of Germany ..... 3520243

[51] Int. Cl.[4] ..... E06C 1/383

[52] U.S. Cl. ..... 182/201; 182/122; 182/166

[58] Field of Search ..... 182/120, 121, 122, 206, 182/201-205, 165-167, 151, 152, 200, 153; 248/188.5, 245, 279, 413; 403/104, 110

[56] References Cited

U.S. PATENT DOCUMENTS

| | | | |
|---|---|---|---|
| 541,806 | 6/1895 | Bobrick | 248/411 |
| 763,209 | 6/1904 | Schwalke | 182/166 |
| 2,943,536 | 7/1960 | Stafford | 248/279 |
| 3,276,543 | 10/1966 | Kanoza | 182/122 |
| 3,710,894 | 1/1973 | O'Dell | 182/122 |
| 4,587,864 | 5/1986 | Kassai | 403/104 |

FOREIGN PATENT DOCUMENTS

| | | | |
|---|---|---|---|
| 644768 | 7/1962 | Canada | 182/122 |
| 606758 | 11/1978 | Switzerland | 182/207 |
| 881997 | 7/1953 | United Kingdom | 182/207 |

*Primary Examiner*—Reinaldo P. Machado
*Assistant Examiner*—Alvin Chin-Shue
*Attorney, Agent, or Firm*—Dennison, Meserole, Pollack & Scheiner

[57] ABSTRACT

A trestle ladder includes adjustable leg extensions to accommodate uneven and irregular surfaces while maintaining the ladder in proper vertical and horizontal orientation. A binding clamp is employed to retain the extension in the desired position and auxiliary rungs are provided for use when the extension of the legs is sufficient to require them.

7 Claims, 8 Drawing Figures

FIG.3
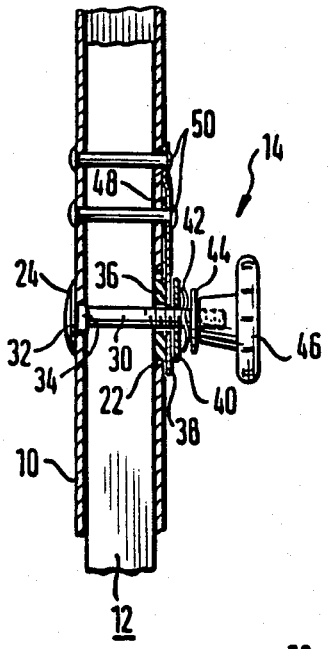
FIG.4
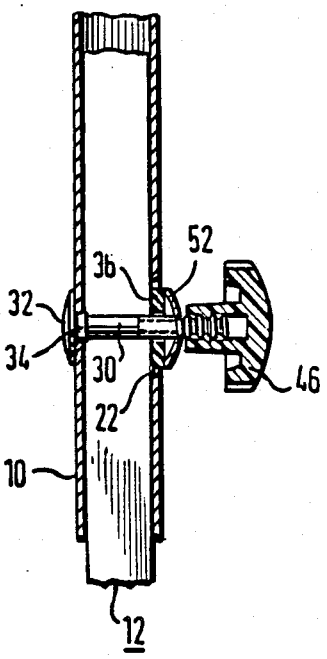
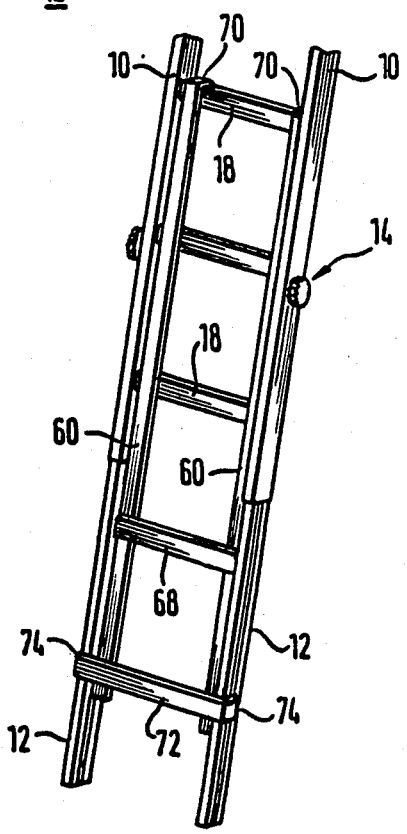
FIG.5

FIG. 6
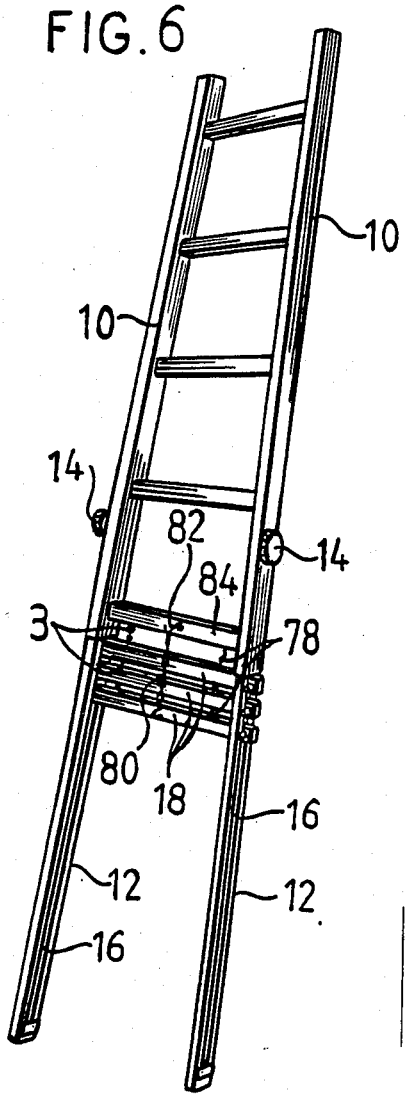
FIG. 8
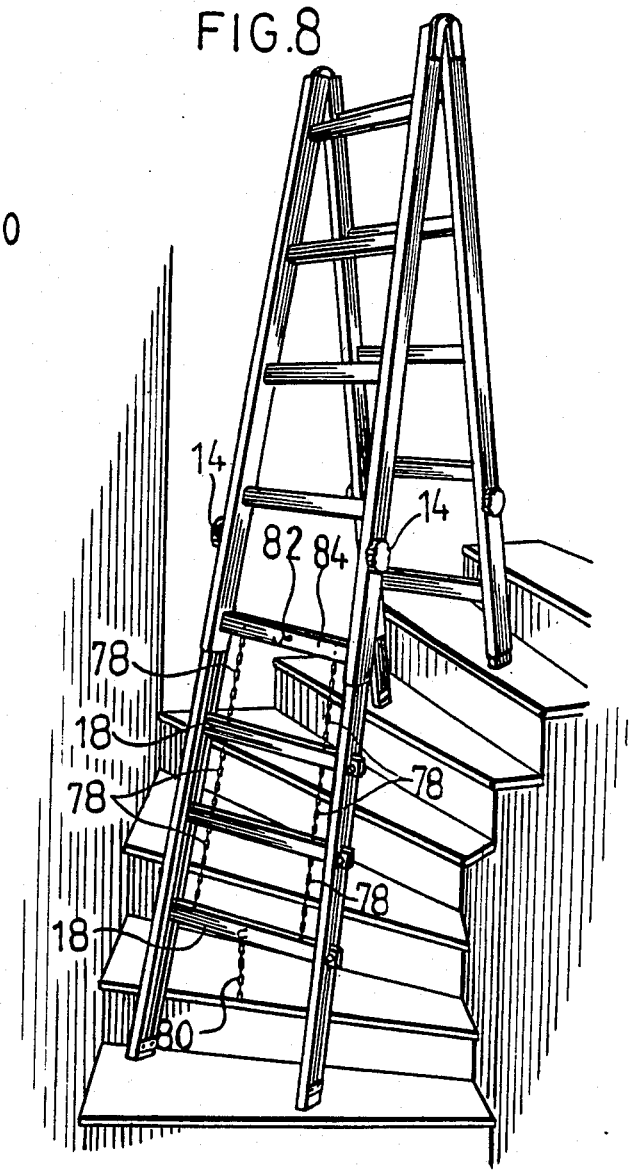
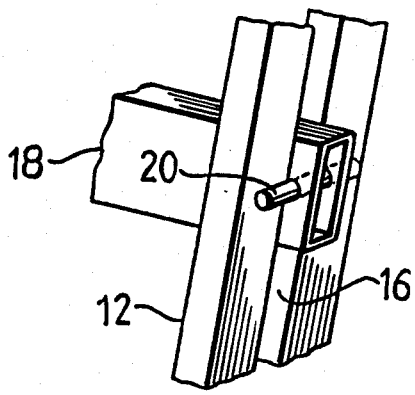
FIG. 7

TRESTLE LADDER

BACKGROUND OF THE INVENTION

This invention relates to ladders in general and particularly to trestle ladders which are generally recognized as two ladders interconnected in an inverted "V" configuration. The invention is concerned with providing a trestle ladder with the capability of accommodating irregular or uneven surfaces at each of its legs while maintaining the body of the ladder in proper horizontal and vertical orientation to safety support a workman and his equipment thereon.

SUMMARY OF THE INVENTION

In utilizing ladders in general, and trestle ladders in particular, workmen are frequently confronted with the need to support the individual legs or rails of the ladder on uneven or irregular surfaces. Painters' ladders, for example, are frequently positioned on various types of staircases and these present particularly graphic examples of such uneven support surfaces. Staircases with landings and circular staircases present even more significant problems to the user of the ladder when access to vertical walls adjacent the staircases is desired. In some instances, it is necessary to provide adjustment for each of the four legs of a trestle ladder to accommodate a different elevation for a supporting surface. Accordingly, it is a primary object of the invention to provide and facilitate adjustment of the legs or rails of a trestle ladder to accommodate such uneven or irregular supporting surfaces upon which the ladder is positioned.

In those instances where substantial extension adjustment of the legs is necessary, it is also contemplated within the field of this invention that supplemental rungs may be provided in the extension area in order that the workman may climb the ladder without an inordinate long distance between the support surface and the first regular rung of the ladder. It is therefore a further object of the invention to provide supplementary or auxiliary rungs selectively securable to the ladder rails, rungs, or extensions thereof to effectively lengthen the operational range of the ladder.

Other objects and advantages will become obvious from a consideration of the following description and drawings wherein like numerals represent like element throughout the several views.

BRIEF DESCRIPTION OF THE DRAWINGS

FIG. 3 is a sectional fragmentary cross-sectional view of the binding mechanism of FIG. 2;

FIG. 4 is a fragmentary cross-sectional view of an alternative embodiment of the binding device;

FIG. 5 is a perspective view of the ladder with an auxiliary ladder in place;

FIG. 6 is a perspective view of a ladder with the extensions extended and auxiliary rungs carried therewith in place;

FIG. 7 is a fragmentary perspective view of a detail of the auxiliary rungs illustrated in FIG. 6; and FIG. 8 is a perspective view of a trestle ladder having telescopic extensions and additional rungs in place in the extension area.

DESCRIPTION OF THE PREFERRED EMBODIMENT

Figure 1:
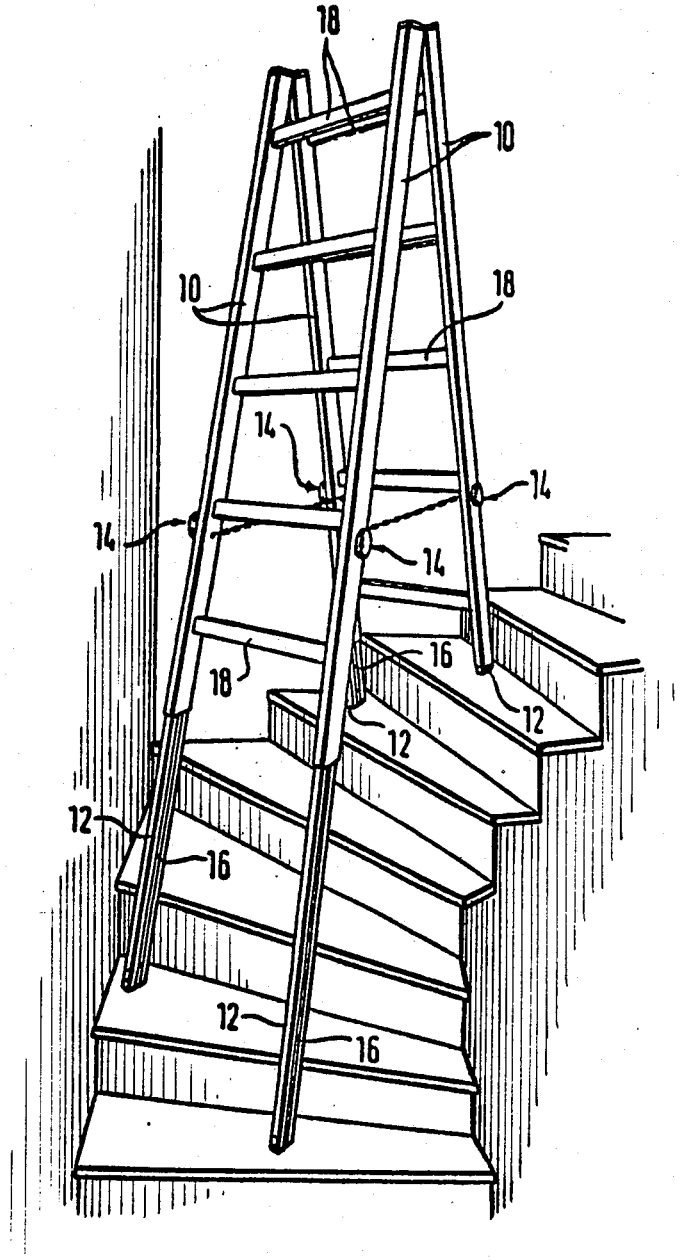
FIG. 1 is a perspective illustration of the preferred embodiment of the trestle ladder of the invention.

Referring now to FIG. 1 of the drawings, a preferred embodiment of a trestle ladder is illustrated as positioned on a circular staircase with each of the four legs supported on a surface of different elevation. As illustrated, the ladder includes conventional uprights or rails 10 separated by vertically spaced rungs 18. Two such ladders are shown with their rails intersecting at the upper extremity to define an inverted V-shaped trestle. Each rail 10 consists of a generally rectangular hollow tube within which is disposed a telescoping extension 12. The extension may be of any suitable length but generally should have sufficient extension capability to accommodate any reasonable need on the part of the user without rendering the ladder unstable or unsafe. Each rail includes a binding means generally illustrated at 14 which will be described more fully hereinafter.

Each extension element includes an elongated transverse slot generally illustrated at 16 extending substantially throughout the length of the extension element.

Referring now more specifically to FIGS. 3 and 4 of the drawings, the binding means shown generally at 14 for securing the extension element in the desired position is illustrated. A binding bolt 30 includes an enlarged head 32 and a threaded shank. The rail 10 is provided with a pair of aligned openings 22 and 24 extending through the walls thereof and the binding bolt is positioned within those openings and preferably with the enlarged head area 32 on the inside of the rail. The binding mechanism is operated by means of a binding wheel 46 threadably attached to the binding bolt 30 in a manner whereby compressive pressure may be applied to the rail 10 and the extension 12 to secure the extension element in the desired position. The binding bolt may include flat shoulders 34 to preclude rotation.

Figure 2:
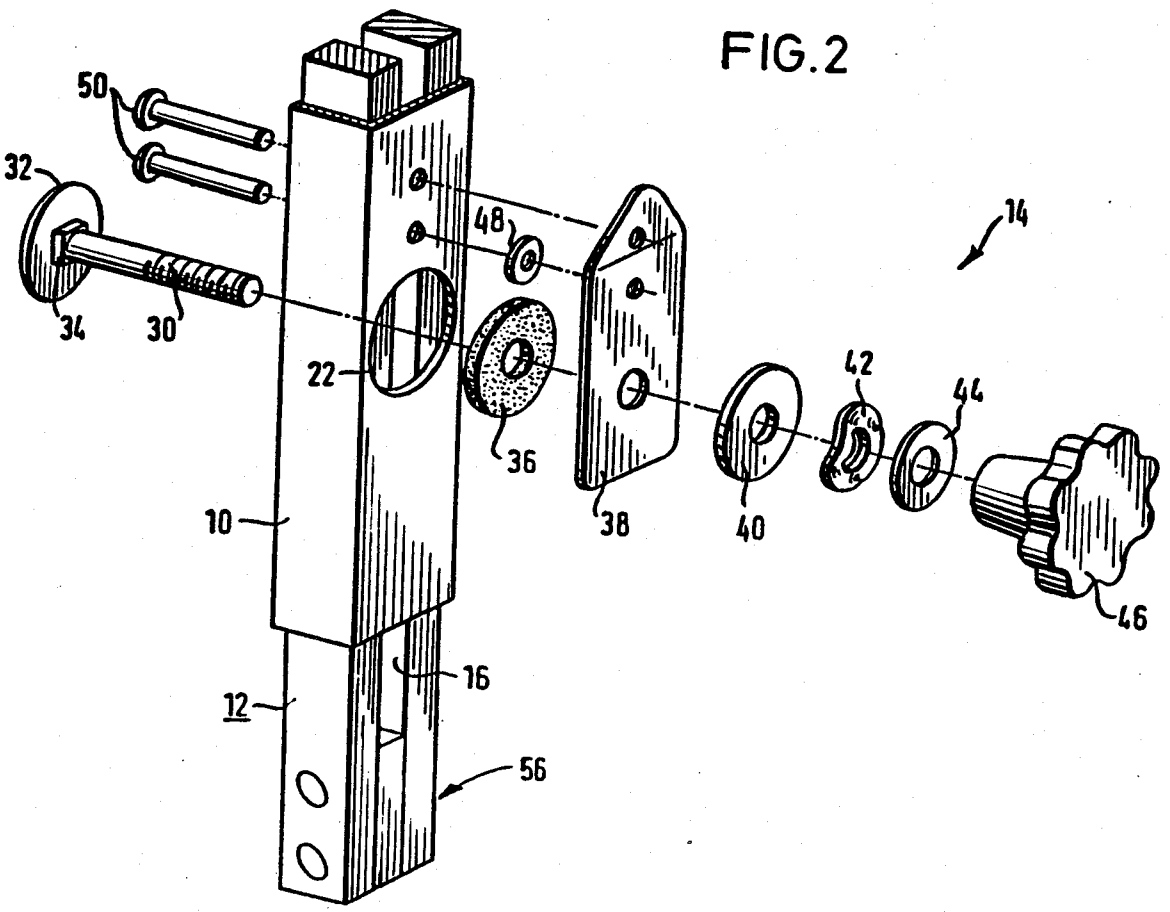
FIG. 2 is an enlarged perspective illustration of the preferred embodiment of the binding device used with the invention.

As illustrated in FIG. 2 of the drawings, the binding means contemplates an enlarged opening 22 on the outside face of the rail 10 within which a flexible binding disk 36 is positioned. The disk is of generally circular configuration with a central opening designed to encircle the shank of the binding bolt 30. A spring plate 38 is secured to the rail 10 by means of a pair of suitable fasteners 50 which also extend through the side walls of the rail 10 and a pair of washers 48. The spring plate includes a central opening through which the binding bolt passes and the plate is configured to overlie the binding disk 36 positioned within the enlarged opening 22. The plate retains the binding disk in position and simultaneously supports the outer shank of the binding bolt in correct axial alignment with the rail 10.

A washer assembly includes an enlarged washer 40, a spring or wave washer 42 and a compression washer 44 between the outer face of the spring plate 38 and the innermost extremity of the threaded binding wheel 46. In the assembled relationship, as illustrated in FIGS. 2 and 3, the binding bolt extends through the leg 10 and is arranged in registry through the slot 16 to permit the application of binding forces by manipulation of the binding wheel 46.

Thus, it may be seen that the various legs of the ladder may be extended by the selective manipulation of the binding means and the positioning of the extension elements to accommodate virtually any elevational situation with which each leg is confronted.

In order to provide for easy ascent and to avoid the extended rung distance illustrated in FIG. 1 between the bottom rung of the ladder per se and the surface or surfaces upon which the extension legs are mounted, auxiliary steps are provided.

As best seen in FIGS. 5, 6, 7 and 8 of the drawings, the auxiliary steps may take any suitable form and as illustrated in the FIG. 5 embodiment include a supplemental pair of uprights 60 provided with hook elements 70 at the upper end configured to engage and be supported by a convenient rung 18 in the ladder body. Any number of transverse auxiliary rungs 68 may be provided and a ledge rung 7 is positioned at the lowermost extremity of the auxiliary ladder portion. The ledge portion includes inwardly directed flanges 74 which are designed to embrace the outer faces of the extensions 12 in order to secure the auxiliary ladder against lateral displacement.

The rung spacing in the auxiliary ladder is generally equivalent to the rung spacing in the primary ladder, thus facilitating ascent and descent by the workman.

FIGS. 6, 7 and 8 of the drawings illustrate a modified embodiment of the auxiliary rung arrangement and in this example, the auxiliary rungs 18 are configured to extend between and through the extension elements 12 in vertically adjustable position within the slots 16. Retention pins 20 as seen best in FIG. 7 insure the lateral position of the auxiliary rungs 18.

Vertical positioning of the auxiliary rungs is controlled by a flexible support element in the form of a pair of chains 78. The rungs are secured in a predetermined spaced relationship along the chains 78 so that upon extension, as many rungs as may be needed may be employed to accommodate the extension elements. If desired, a third chain 80 may be utilized to secure the rungs in the collapsed condition as best seen in FIG. 6. An appropriate retention hook 82 on the lowermost rung 84 will enable the rungs to be moved into a stacked or storage position. As seen in FIG. 8, the chains 78 supporting the rungs are attached to the lowermost rung in the ladder 84 and are moved into a flaccid condition when the rungs are in the retained stacked condition seen in FIG. 6.

In operation, the workman will position the ladder for access to a wall or other object on which work is to be performed and by the manipulation of the binding wheels 46 on each of the several legs of the trestle ladder, adjustment of the extension elements 12 to whatever degree may be required in order to accommodate the irregular surface while maintaining the ladder in a stable vertically and horizontally oriented position. Upon achieving such extension, the binding wheel is tightened by rotating the same until sufficient compressive pressure is applied to the binding mechanism to support the extension element in the desired position. This procedure is repeated for each leg where adjustment is necessary.

The auxiliary legs may then be placed in position by hanging the hooks 70 over a convenient rung of the ladder to permit the embodiment illustrated in FIG. 5 to extend to a position near the supporting surface while simultaneously providing appropriate rung spacing for a safe ascent.

In the embodiment of FIGS. 6–8, the retention chain 80 is released and the several rungs are allowed to move vertically by gravity within the slots of the extension elements to a position where the chains are in a supporting position with the proper rung spacing determined by the number of links in each chain between successive rings.

It will be obvious that many variations of the binding means and the auxiliary rung arrangements may be employed within the scope of the appended claims and those arrangements illustrated in the drawings are to be considered as exemplary of operational embodiments and not of restriction.

I claim:

1. In a trestle ladder including two hingedly connected pairs of metallic tubular rails, each pair of said rails being separated by a plurality of rungs, each of said rails having a hollow tubular profile substantially throughout its length, telescoping extension means independently slidably positioned within each of said tubular rails, said extension means each configured to slide between extended and retracted positions within each of said rails independently and selectively securable in any position between said extended and retracted positions, each of said extension means including a foot portion and an elongated body portion, means defining a continuous transverse slot extending through said body portion substantially throughout the length of each extension, and binding means including a portion extending transversely through each of said rails and through the slot in each extension to frictionally retain said extension in an infinite number of predetermined positions with respect to its complementary rail.

2. The invention of claim 1 wherein said binding means includes a non-rotatable binding bolt having an enlarged head portion and a threaded shank portion, said shank portion being configured to extend through at least one of said rails, a spring loaded binding disk mounted on said mounting bolt and engageable with said extension, and binding wheel means threadably attached to said bolt whereby binding compressive forces may be selectively applied to said rail and said extension to secure said extension in a predetermined position.

3. The invention defined by claim 2 wherein said binding means includes a spring plate mounted on said rail, an aperture extending through said plate aligned with and configured to supportingly receive the threaded shank of said binding bolt to selectiveldy apply pressure forces on said binding disk, said extension and said rail and spring washer means mounted on said bolt between said spring plate and said binding wheel to retain said binding wheel in a preselected position when said pressure forces are applied to said binding disk.

4. The invention of claim 1 wherein auxiliary rungs are mounted on said ladder and extend across said extensions when said rails are sufficiently elongated by said extensions to support said auxiliary rungs in a predetermined spaced parallel relationship with the rungs extending between the ladder rails.

5. The invention of claim 4 wherein said auxiliary rungs are mounted on a spaced pair of supplemental uprights each including fastening means securable to said ladder and wherein said auxiliary uprights extend below the ladder rails and between the extension means of each rail to position and support said auxiliary rungs in predetermined spaced relation to said rungs on said ladder.

6. The invention defined by claim 5 further including a ledge rung adjacent the lower end of said auxiliary uprights and including portions extending over and partially around each of said extension means to prevent lateral displacement of said auxiliary rungs with respect to said ladder and said extension means.

7. In a ladder construction comprising a pair of upright rail members and a plurality of parallel rungs extending therebetween, the combination comprising slotted extension means connected to each of said rail members and independently selectively extendable with respect thereto to a predetermined position, retention means on said rails to retain said rails and said extension means in said predetermined position and auxiliary rung means supported by said ladder and said extension means to provide at least one auxiliary rung extending through and between said respective extensions within said slots and parallel to said rungs regardless of the differential extension of said extension means with respect to said rail members.

* * * * *